US012416107B2

(12) United States Patent
Galan Llongueras et al.

(10) Patent No.: US 12,416,107 B2
(45) **Date of Patent: *Sep. 16, 2025**

(54) YARN SPINNING AND/OR TWISTING MACHINE

(71) Applicants: TWISTPERFECT, S.L., Terrassa (ES); CASUMCONI, S.L., Viladecavalls (ES)

(72) Inventors: Albert Galan Llongueras, Terrassa (ES); Jordi Galan Llongueras, Terrassa (ES); Jose Antonio Latorre Raez, Terrassa (ES)

(73) Assignees: Twistperfect, S.L., Terrassa (ES); Casumconi, S.L., Viladecavalls (ES)

( * ) Notice: Subject to any disclaimer, the term of this patent is extended or adjusted under 35 U.S.C. 154(b) by 0 days.

This patent is subject to a terminal disclaimer.

(21) Appl. No.: 18/268,456

(22) PCT Filed: Nov. 9, 2021

(86) PCT No.: PCT/ES2021/070807

§ 371 (c)(1),
(2) Date: Jun. 20, 2023

(87) PCT Pub. No.: WO2022/101534

PCT Pub. Date: May 19, 2022

(65) Prior Publication Data

US 2024/0068134 A1 Feb. 29, 2024

(30) Foreign Application Priority Data

Nov. 10, 2020 (ES) ..... ES202032423U

(51) Int. Cl.
*D01H 13/04* (2006.01)
*D01H 1/02* (2006.01)
(Continued)

(52) U.S. Cl.
CPC ..... *D01H 13/04* (2013.01); *D01H 1/02* (2013.01); *D01H 7/604* (2013.01); *D01H 13/20* (2013.01)

(58) Field of Classification Search
CPC ..... D01H 1/02; D01H 1/24; D01H 7/604; D01H 13/04; D01H 13/20
(Continued)

(56) References Cited

U.S. PATENT DOCUMENTS 2,386,704 A * 10/1945 McLellan ..... D01H 1/425 57/357
2,473,520 A * 6/1949 Gwaltney ..... D01H 1/02 57/75
(Continued)

FOREIGN PATENT DOCUMENTS

CA 3048433 A1 * 7/2018 ..... B65H 57/22
CN 203807634 U 9/2014
(Continued)

OTHER PUBLICATIONS

Int'l Search Report for PCT/ES2021/070807, dated Feb. 3, 2022.

*Primary Examiner* — Shaun R Hurley
(74) *Attorney, Agent, or Firm* — MaxGoLaw PLLC

(57) ABSTRACT

A yarn spinning and/or twisting machine with multiple balls, comprising a yarn-feeding means (1), a yarn collection means for the yarn (4) with a rotation axis (V), a yarn guide (8) located between the yarn-feeding means (1) and the yarn collection means (4), means for the generation of the diameter of the ball (DB), motorised means linked to the yarn collection means (4), where the internal diameter of the yarn guide (8) is greater than the diameter of standard yarn guides (8) for each type of yarn, and smaller than 1.1 times the diameter of the ball generator (DB). Preferably, the internal diameter of the yarn guide (8) is between 0.01 and 0.9 times the diameter of the ball generator (DB). Preferably, the yarn
(Continued)

spinning and/or twisting machine comprises several yarn guides (8, 8', 8"), at least one of these with an internal diameter greater than the diameter of the standard yarn guide (8) for each type of yarn and smaller than 1.1 times the diameter of the ball generator (DB).

14 Claims, 10 Drawing Sheets

(51) Int. Cl.
*D01H 7/60* (2006.01)
*D01H 13/20* (2006.01)

(58) Field of Classification Search
USPC ..... 57/75, 354, 356
See application file for complete search history.

(56) References Cited

U.S. PATENT DOCUMENTS

| | | | | |
|---|---|---|---|---|
| 4,604,863 | A | 8/1986 | Fisher et al. | |
| 6,332,312 | B1 * | 12/2001 | Loscher | D01H 7/18 57/354 |
| 6,487,841 | B1 * | 12/2002 | Dalitz | D01H 9/14 57/75 |
| 2022/0010465 | A1 * | 1/2022 | Galan Llongueras | D01H 7/52 |
| 2022/0235495 | A1 * | 7/2022 | Galan Llongueras | D01H 13/04 |
| 2024/0035207 | A1 * | 2/2024 | Galan Llongueras | D01H 13/06 |

FOREIGN PATENT DOCUMENTS

| | | | |
|---|---|---|---|
| CN | 106149119 | A | 11/2016 |
| DE | 19523847 | A1 | 1/1997 |
| EP | 3540102 | A1 | 9/2019 |
| FR | 2546915 | A1 | 12/1984 |
| JP | H093733 | A | 1/1997 |

* cited by examiner

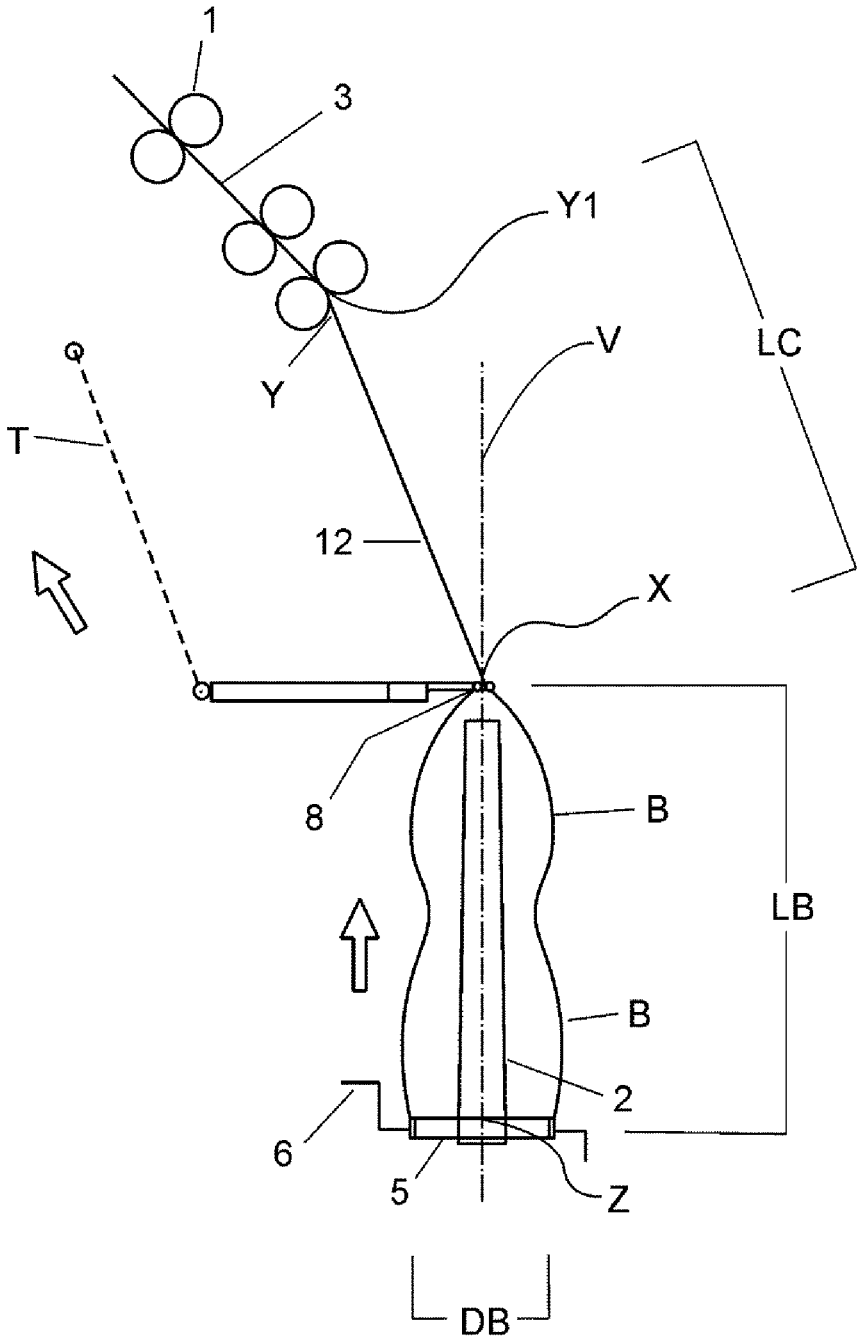
FIG. 1-A

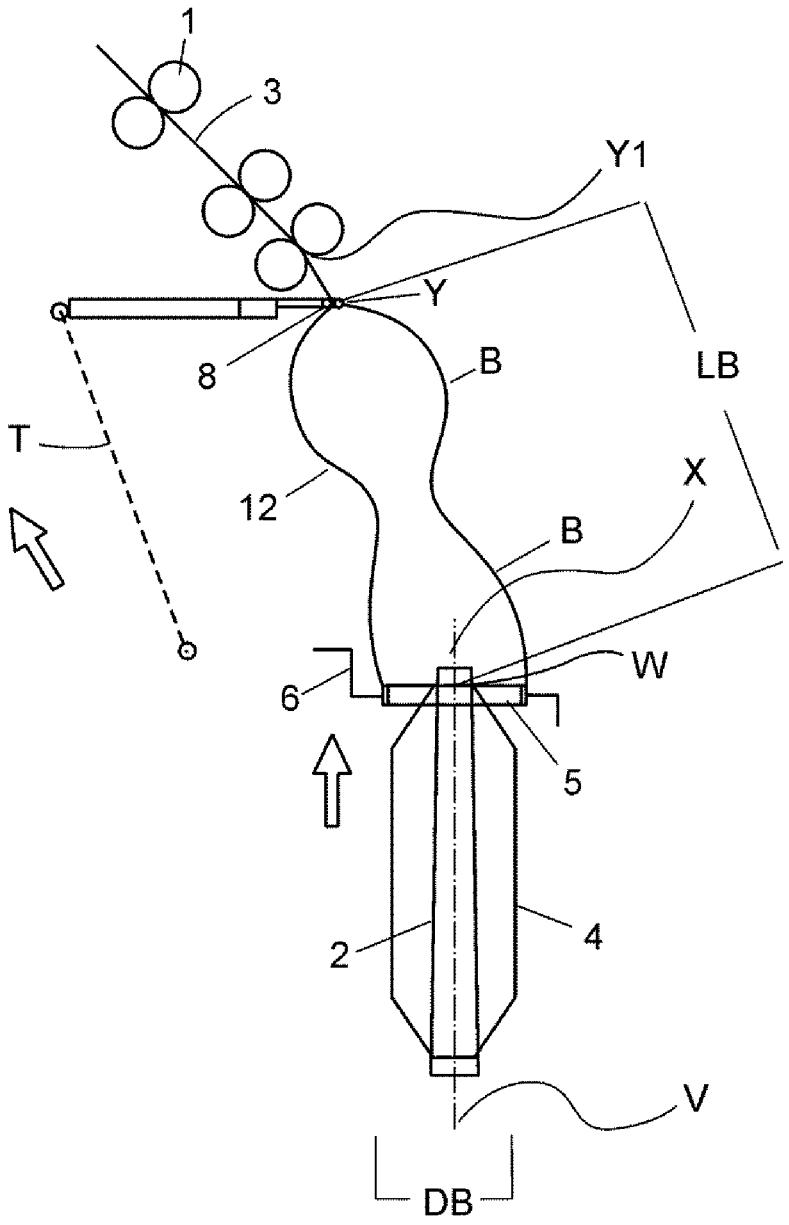
FIG. 1-B

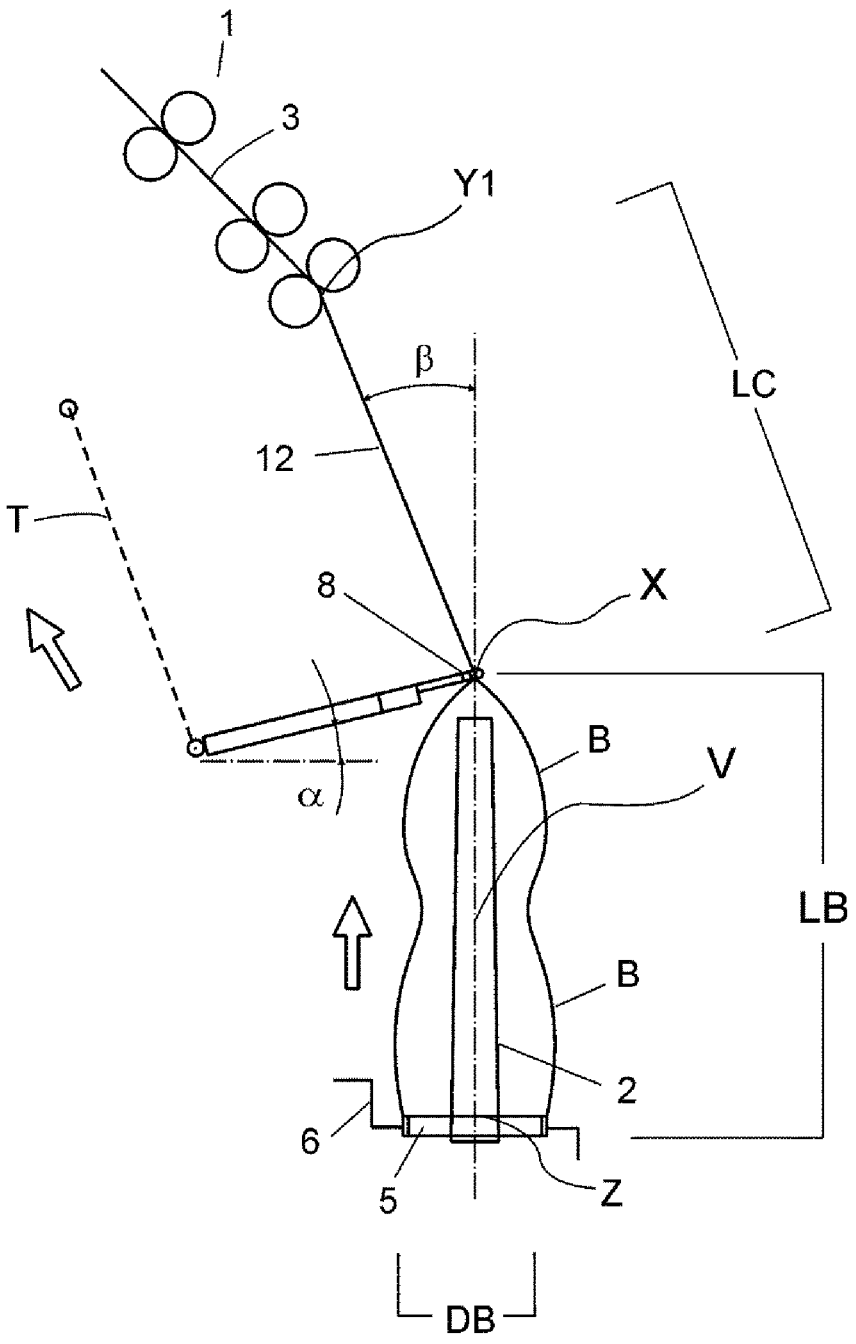
FIG. 2-A

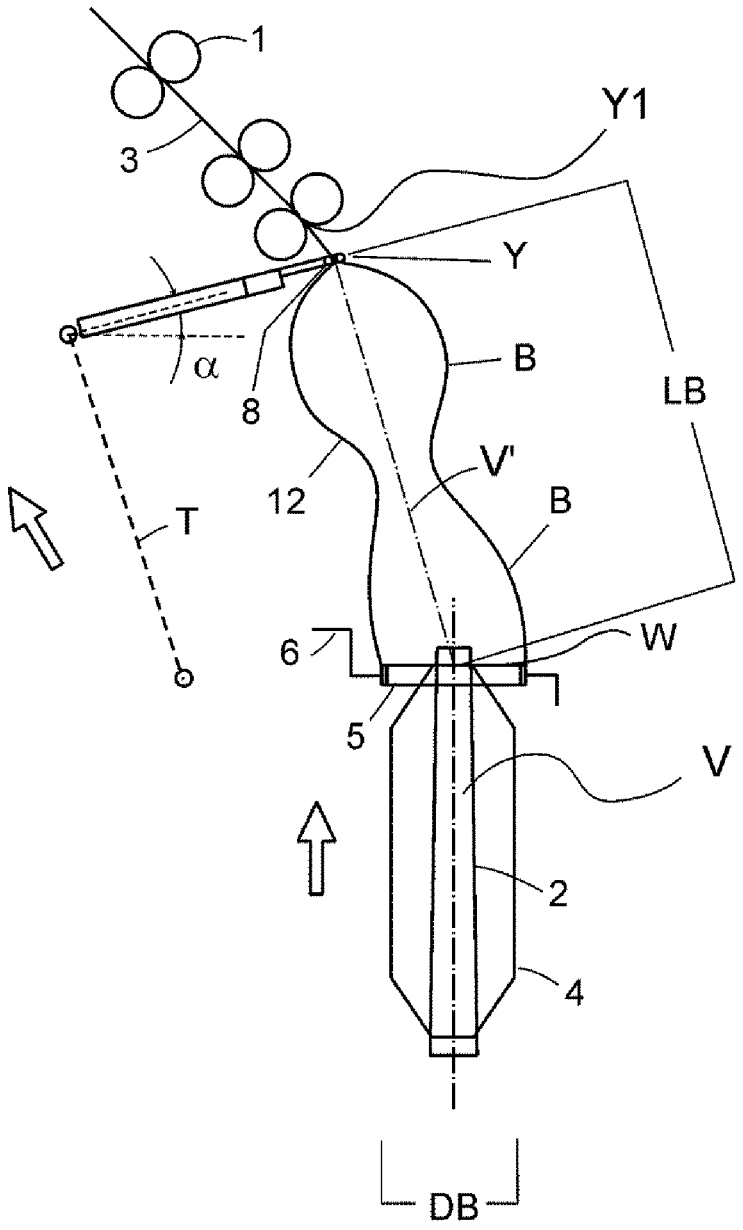
FIG. 2-B

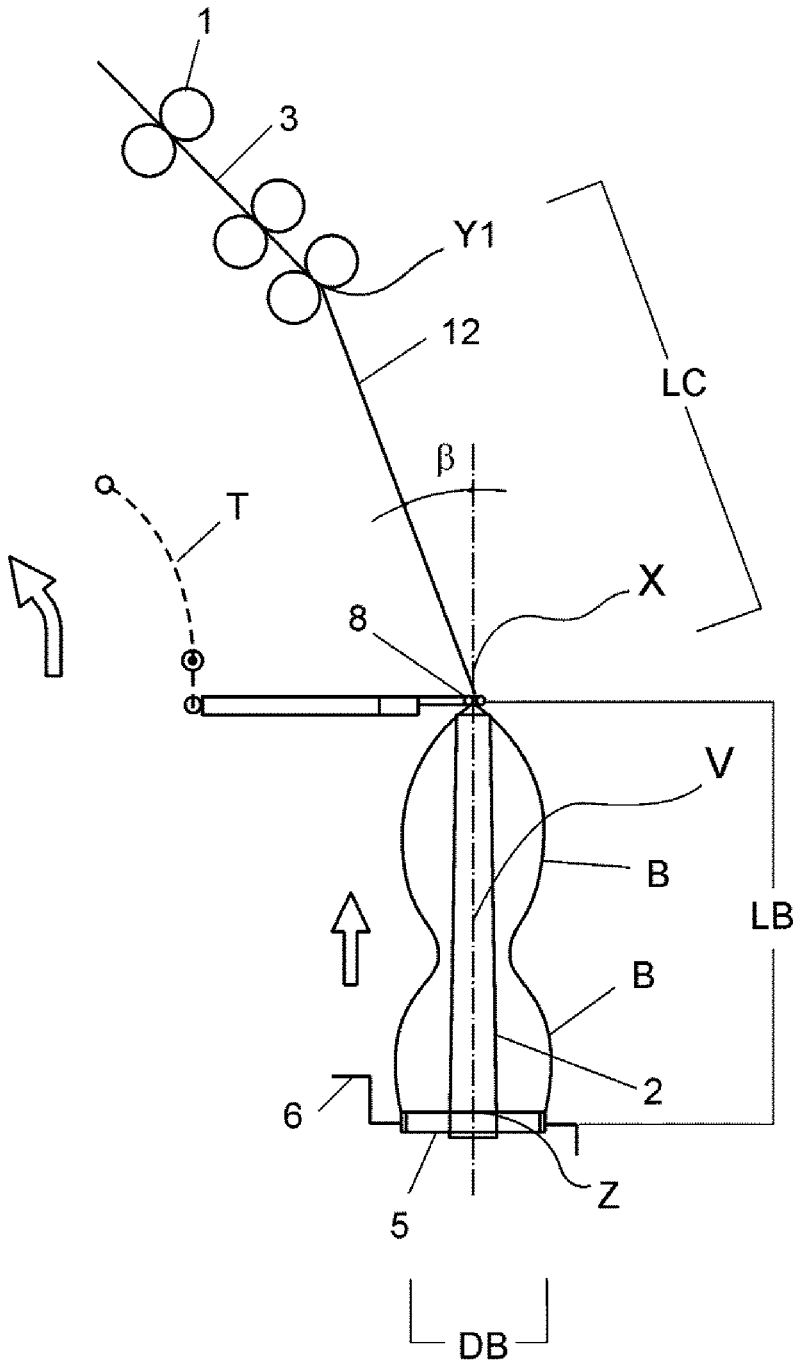
FIG. 3-A

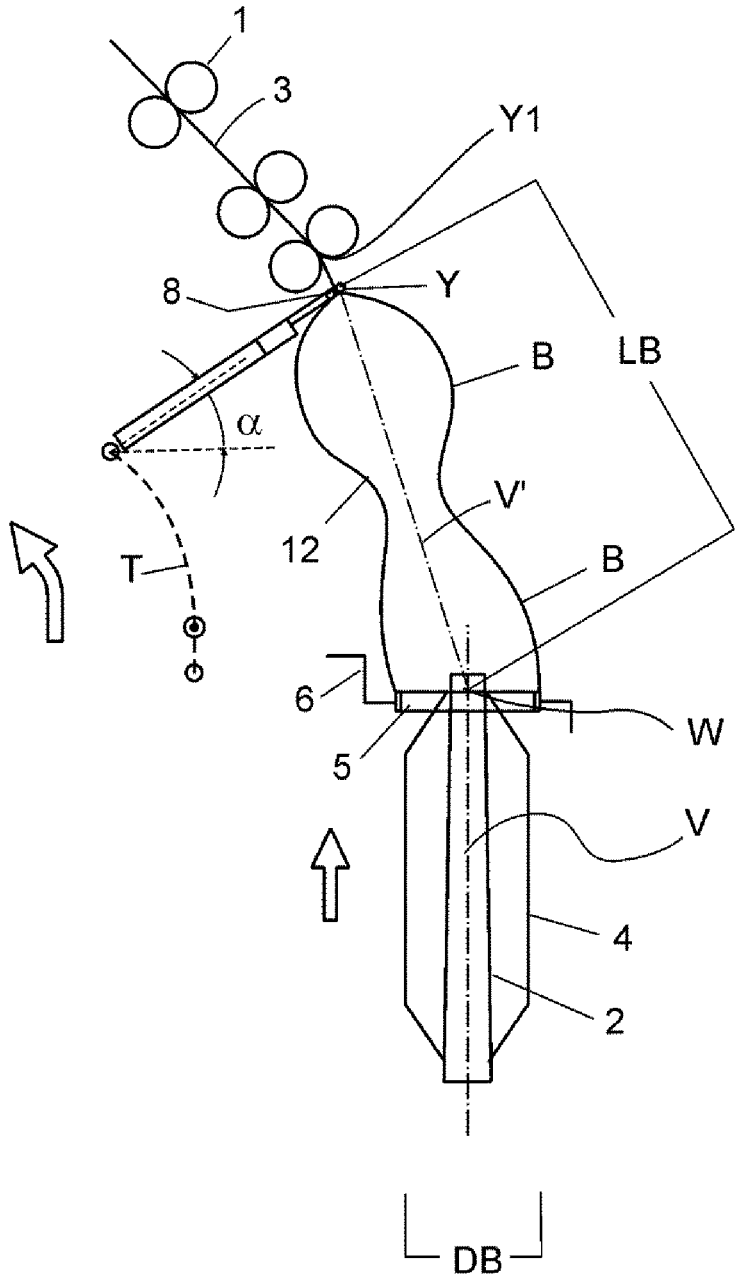
FIG. 3-B

YARN SPINNING AND/OR TWISTING MACHINE

OBJECT OF THE INVENTION

The invention, as stated in the title of the present specification, relates to a yarn spinning and/or twisting machine providing, to its intended use, advantages and features, which are described in detail further on, which imply an improvement in the current state of the art.

The object of the present invention focuses on a yarn spinning and/or twisting machine comprising a yarn guide with an inner diameter of the yarn guide being greater than the diameter of standard yarn guides, such that there is generated between the yarn exit point of the yarn feeding means and the yarn guide a vibration which causes the stress of the yarn to be more constant, stable, and balanced, and accordingly causes the shape and number of the balloons between the yarn guide and the balloon diameter generating means to be more constant.

Additionally, the invention proposes using means for moving the relative position of the yarn guide with respect to the yarn exit point of the yarn feeding means with a path not aligned with the spin axis during a spinning cycle, such that the path of the yarn along the total height of the balloons formed by the yarn does not collide with the yarn picking means and the stress is more constant, and accordingly such that the shape and number of the balloons between the yarn guide and the balloon generating means, which are the ring and traveller, are as constant as possible.

The invention also comprises other technical features which cause the stress of the yarn to be as constant as possible, and accordingly cause the shape and number of the balloons between the yarn guide and the ring and traveller to also be as constant, stable, and balanced as possible.

FIELD OF APPLICATION OF THE INVENTION

The field of application of the present invention is comprised within the sector of the industry dedicated to the manufacturing of balloon spinning and twisting machines; among others, ring spinning machines, ring twisting machines, cabling twisting machines, 2×1 or TFO double twisting machines, mills.

BACKGROUND OF THE INVENTION

As is known, in processes of spinning and twisting yarn with multiple balloons, regardless of the type of machine, it is desirable that the stress of the yarn and the shape of the balloon are as constant and stable as possible.

Spinning and twisting machines which process yarn with the multiple balloon technology basically comprise:

- yarn feeding means, with a yarn exit point aligned or not aligned with the spin axis of the yarn picking means for the yarn,
- yarn picking means with an spin axis,
- a yarn guide, located between the yarn feeding means and the yarn picking means for the yarn or spindle,
- balloon generating means, consisting for example of a traveller-ring assembly, that are vertically movable and concentric with the spin axis of the yarn picking means in the case of a machine with rings,
- and drive means connected to the yarn picking means,
- such that when the yarn picking means spins about the spin axis thereof as a result of the drive means, the yarn runs from the yarn feeding means to the traveller-ring assembly which directs it to the yarn picking means, once it has gone through the yarn guide with a multiple balloon configuration and a helical path.

During the spinning or twisting process, the stress of the yarn can vary, changing the shape of the balloon, and finally in the case of machines with rings changing the position of the traveller with respect to the ring. There different reasons causing a change in stress of the yarn. The changes in stress of the yarn change the geometry of the balloons.

In the case of spinning and/or twisting machines that work with multiple balloons, the change in stress sometimes causes a change in the number of balloons generated. For example, the number of balloons goes from 2 to 3 or from 3 to 4 and vice versa, i.e. from 3 to 2 or from 4 to 3.

In machines with rings, this change in the shape or number of generated balloons causes the traveller to move in an uncontrolled manner in the ring for some time and to have several points of contact between the traveller and the ring, causing premature wear of the traveller and breakages of yarn.

One of the reasons for this situation is that the angle of the yarn with the base of the ring, measured at the left tangent end of the ring in the front view thereof, goes from more than 90° to less than 90° with respect to the base of the ring or horizontal. This change causes stress to vary in an unstable manner for a certain time until it returns, after some time, to the initial position or changes the number of balloons, reaching equilibrium once again. This new state of equilibrium with one balloon more or less causes the position of the traveller to again be more than 90° and the point of contact of the traveller with the ring to be the correct one, optimising traveller durability to the greatest extent possible, preventing the breakages of yarns, and/or premature changes of the traveller which lead to part consumption, machine downtime (reduced efficiency), and labour cost for changing the travellers.

The instability of the balloon or the change in state from one number of balloon to another number of balloon, regardless of the number, usually occurs in specific spinning conditions, such as the height of the yarn guide with respect to the traveller and ring assembly or with respect to the yarn exit point, the weight of the traveller, the balloon generating diameter, the diameter of the yarn guide, the type of yarn, material, spinning system (combing, carding, etc.), twisting, model of the machine, state of wear of the traveller and of the rings, the height of the tube, the diameter of the ring, the height of the ring, the diameter of the tube, among others.

Therefore, in order to obtain optimal traveller durability, it would be desirable to ensure that the traveller does not change the angle of the yarn with the base of the ring and maintains a stable path and position. In order for it to not move, there is a need to prevent the instability of the balloon or changes in the state or transition of one balloon to another affecting the stability of the position of the traveller.

Varying the stress of the yarn during the spinning and/or twisting process causes, among other consequences, the traveller to move in an uncontrolled manner in the ring for some time and to have several points of contact between the traveller and the ring, causing premature wear of the traveller and breakages of yarn.

By way of example, on average, a traveller usually last between about 4 and 8 days when spinning short fibres. It must be changed for a new one after this period. The position of the traveller in the ring and the friction and wear areas of the traveller, particularly the friction areas between the traveller-ring and traveller-yarn, are widely studied.

When the traveller is not changed pre-emptively, breakages of yarns start to occur, making it necessary for the operator to pay attention in joining them, reducing machine efficiency, since no production is carried out in that position for some time, and reducing spinning quality because this yarn will have a weak area or point which is about 80% of the normal strength in spinning and twisting.

Therefore, it is particularly important for the traveller to have a stable position throughout the entire spinning process.

It would be interesting to find a solution that will prevent the change in the number of generated balloons and vibrations, and accordingly prevent the change in relative position between the traveller and the ring in the case of machines with rings.

Moreover, in machines with rings, the yarn picking means comprise a spindle spinning with respect to a fixed structure. For the purpose of correctly picking or folding the yarn onto the spindle, the traveller-ring assembly is movable with respect to the spindle in up and down vertical movements of a certain distance until completing the spinning cycle. During the spinning cycle, the yarn guide is also movable with a movement associated with the position of the traveller-ring assembly, with a distance between them defined as LB (height of the multiple balloon area) being created. During the spinning cycle, this distance LB may or may not be constant, and it will depend on the stress of the yarn and/or the amount of balloons, which may be changing during the spinning cycle.

The traveller is an element which, in addition to properly directing the yarn to the spindle of the yarn picking means, allows regulating, through its mass (milligrams), the stress of the yarn and the geometry of the multiple balloons during the yarn spinning and/or twisting process.

There are different specific ring spinning and twisting technologies with multiple balloons:

On one hand, WO2018122625 describes a spinning and twisting machine with rings which processes yarn with multiple balloons, wherein the yarn guide located after the feeding system is always concentric to the spin axis of the spindle and is movable in a vertical path aligned with said axis.

When the dimensions of the machine allow the multiple balloon area to have a significant height, said system is perfectly valid because the yarn exit angle R or spinning angle from the feeding system to the yarn guide allows it to be less than 60° with respect to the vertical and allows generating a suitable and stable spinning triangle that has no breakages.

Spinning triangle is known in the sector and is defined as the triangle of the bundle of fibres departing the exit point of the feeding means, right at the moment where they are twisted for conversion into a yarn. A suitable spinning triangle is associated with a spinning angle beta that is also suitable and never more than 60° with respect to the vertical.

Spinning triangle is not a critical element in ring twisting.

A known option in the state of the art in balloon spinning for reducing changes in stress of the yarn is to move the position of the yarn guide, but always onto the spin axis of the spindle of the picking means.

The following movements of the yarn guide are known:

i—The yarn guide moves with the same movement of the bobbin rail or traveller-ring assembly. Accordingly, the distance between the yarn guide and the traveller-ring assembly is constant.

ii—The yarn guide moves in a synchronised manner with the movement of the bobbin rail or traveller-ring assembly. For example, the location of the yarn guide is at the midpoint of the distance between the traveller-ring assembly and the yarn exit point of the feeding means.

iii—The yarn guide does not move. The yarn guide is fixed and is independent of the movement of the bobbin rail or traveller-ring assembly. The yarn guide is located at any point of the spin axis of the spindle of the picking means.

iv—The yarn guide moves completely independent of the movement of the bobbin rail or traveller-ring assembly.

Sometimes, particularly during ring spinning, when the yarn exit point of the yarn feeding means is arranged close to the yarn guide, a very pronounced spinning angle (greater than 60° with respect to the vertical) which causes the breakages of the yarn is generated when the yarn guide is moved up vertically and concentrically with respect to the spin axis of the yarn picking means.

It would be interesting to find a solution that would allow the movement of the yarn guide for the purpose of keeping the stress of the yarn constant, while at the same time keeping the spinning angle within suitable parameters to prevent breakages.

Other times, when the yarn exit point of the yarn feeding means is not aligned with the spin axis of the yarn picking means for the yarn, the path of the yarn between the yarn feeding means and the traveller-ring assembly can collide with the yarn picking means, such as the spindle of the yarn picking means.

Therefore, it would also be interesting to find a solution that will prevent the path of the yarn from colliding with the yarn picking means for the distance or area between the yarn guide and the traveller-ring assembly when the yarn exit point of the yarn feeding means is not aligned with the spin axis of the yarn picking means for the yarn.

Furthermore, and as a reference to the current state of the art, it should be noted that at least the applicant is unaware of the existence of any other spinning machine or invention which presents technical features that are the same or similar to those presented by that which is claimed herein.

BRIEF DESCRIPTION OF THE DRAWINGS

FIG. 1A shows a schematic view of the depiction of a yarn spinning and/or twisting machine with the yarn guide located at the lower point of its rectilinear path and not aligned with the spin axis of the picking means and the traveller-ring assembly located in the minimal initial position;

FIG. 1B shows a schematic view of the depiction of the yarn spinning and/or twisting machine shown in FIG. 1A, in this case with the yarn guide located at the upper point of its rectilinear path and not aligned with the spin axis and the ring located in the maximum end position;

FIG. 2A again shows a schematic view of the depiction of a yarn spinning and/or twisting machine, herein depicted with the yarn guide located at the lower point of its rectilinear path and not aligned with the spin axis of the picking means and the ring located in the minimal initial position, where in this case, the yarn guide furthermore has an angle of inclination of several degrees with respect to the horizontal;

FIG. 2B shows a schematic view of the depiction of the yarn spinning and/or twisting machine shown in FIG. 2B, in this case depicted with the yarn guide located at the upper point of its rectilinear path and not aligned with the spin axis of the picking means and with the ring located in the maximum end position, the yarn guide having an angle of inclination of several degrees with respect to the horizontal;

FIG. 3A likewise shows a schematic view of the depiction of a yarn spinning and/or twisting machine, in this case, with the yarn guide located at the lower point of its non-rectilinear path and not aligned with the spin axis of the yarn picking means and the ring located in the minimal initial position;

FIG. 3B shows a schematic view of the depiction of the yarn spinning and/or twisting machine shown in FIG. 3B but, in this case, with the yarn guide located at the upper point of its non-rectilinear path and not aligned with the spin axis of the yarn picking means and the ring located in the maximum end position;

SUMMARY DESCRIPTION OF THE INVENTION

Figure 4:
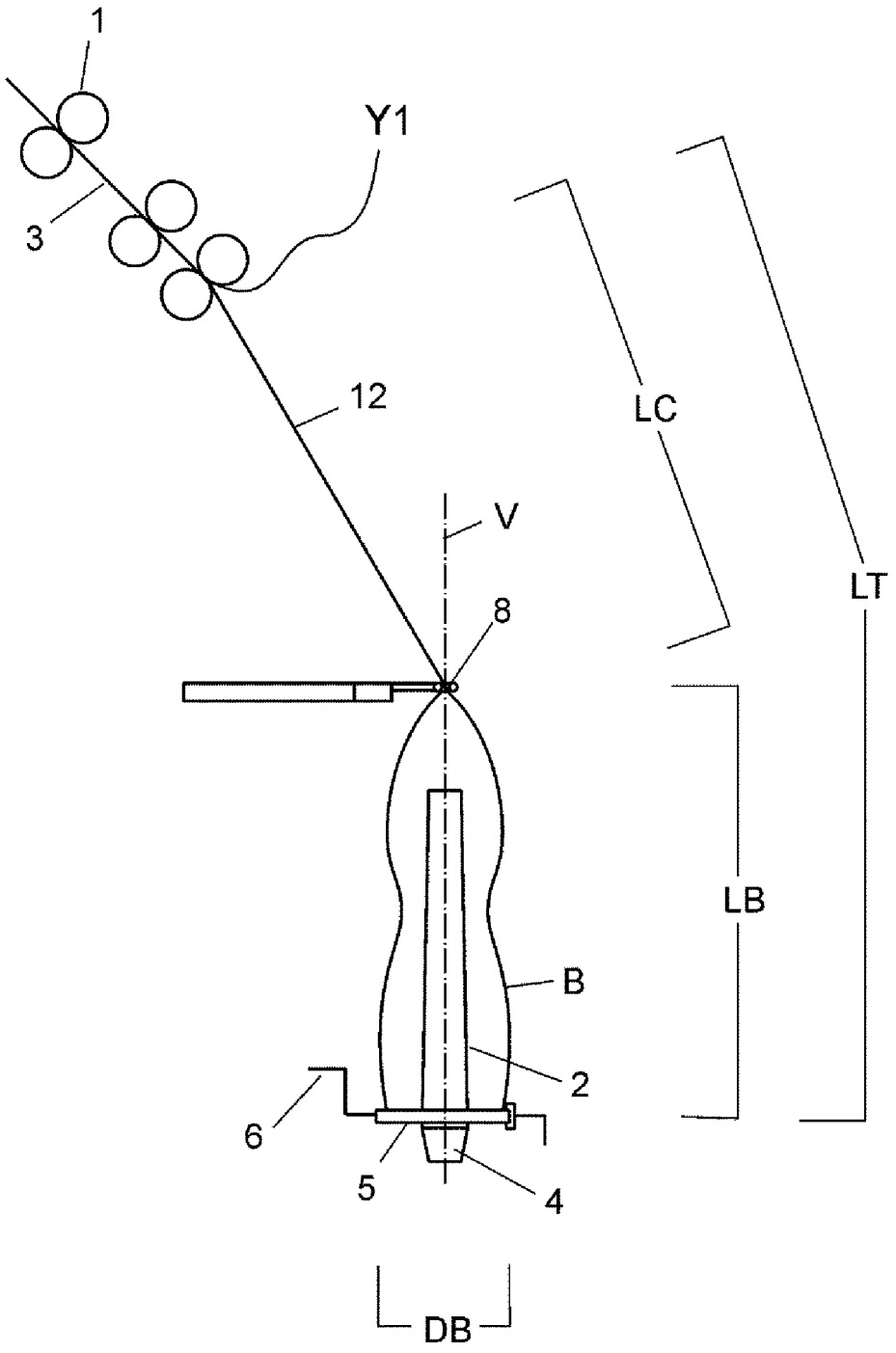
FIG. 4 shows an elevational view of another schematic depiction of another example of a yarn spinning and/or twisting machine with more than one balloon, according to the state of the art, where the main parts and elements it comprises, as well as the relative arrangement thereof, can be seen.

The yarn spinning and/or twisting machine proposed by the invention is configured as the ideal solution to the problem of how to prevent the path of the yarn along the area between the yarn guide and the balloon generating means from colliding with the yarn picking means when the yarn exit point of the yarn feeding means is not aligned with the spin axis of the yarn picking means for the yarn.

A second objective of the invention relates to how a suitable spinning angle can be maintained throughout an entire spinning or twisting process in machines which are limited by their height or distance between the yarn outlet of the feeding system and the ring, and at the same time processing the yarn with the multiple balloon technology and for the purpose of keeping the stress of the yarn as constant as possible, and therefore preventing breakages thereof.

The characterising details of the invention which make it possible are set forth in the final claims accompanying the present description.

Specifically, a yarn spinning and/or twisting machine with multiple balloons comprising, like all standard machines:

- yarn feeding means, with a yarn exit point aligned or not aligned with the spin axis of the yarn picking means for the yarn,
- yarn picking means for the yarn with an spin axis,
- a yarn guide, located between the yarn feeding means and the yarn picking means for the yarn,
- balloon generating means consisting, for example in the case of machines with a ring, of a traveller-ring assembly, that are vertically movable and concentric with the spin axis of the picking means,
- drive means connected to the yarn picking means for the yarn.

The machine object of the invention comprises a yarn guide with the inner diameter of the yarn guide being greater than the inner diameter of standard yarn guides and less than 1.1 times the balloon generating diameter.

In a balloon yarn spinning and/or twisting machine, yarn guide is an element which has the main function of centring the yarn in the spin axis of the balloon generating means, i.e., at the centre of the ring or balloon generating diameter. This element is important because, in yarn spinning and twisting and the exit of the yarn from the drafting unit or the yarn feeding rollers, it is generally separated from the spin axis of the balloon generating means so as to leave space for spinning package extraction elements and/or to maintain the concept of spinning triangle.

The inner diameter of the yarn guide with one balloon usually tends to 0, with inner diameter dimensions of between 2 and 4 mm being the conventional ones for simply allowing the passage of the yarn therethrough to prevent vibrations in a balloon spinning process.

Furthermore, the yarn guides are usually positioned as close as possible to the spindle, i.e., attempt is made to reduce the distance between the yarn guide and the balloon diameter generating means, so that the diameter of the balloon is the smallest possible and more spinning stations can thus be arranged in the same machine. If said distance in a balloon spinning and/or twisting process increases, the diameter of the balloon increases due to the centripetal force of the yarn up to the limit which breaks the yarn and/or contacts the spindle separator.

The person skilled in the art knows that if the diameter of the yarn guide is changed, an effect on the hairiness of the yarn is produced, i.e., the greater the yarn inner diameter, the lower the yarn quality due to an increase in hairiness as a result of the vibrations produced before the yarn guide in a balloon spinning process.

Moreover, in the balloon spinning and/or twisting machines, an element referred to as a balloon control ring is generally used the main function of which is to prevent the diameter of the balloon from increasing too much when working at high spinning speeds. When balloon spinning is performed at high speeds, the diameter of the balloon increases due to the centripetal force of the yarn and the yarn may break when it collides with the spinning station separator. To prevent this negative effect and to have the diameter of the balloon under control so that the yarn does not collide with the spinning station separators, a control ring is placed. The diameter of the control ring is usually greater than the diameter of the balloon generating means, for the purpose of allowing the spindle of the yarn picking means to be able to move within the control ring. The control rings usually have an inner diameter of at least 1.1 times the ring or balloon generating diameter.

In this patent, it has been discovered that the size of the inner diameter of the yarn guide, i.e., the diameter of the hole of the yarn guide, has a substantial influence on the shape of balanced, freely obtained balloons and on the stress of the yarn when performing multiple balloon spinning and/or twisting.

An inner diameter of the yarn guide greater than the diameter of standard yarn guides allows vibrations to be generated, in the area between the exit point of the yarn feeding means and the yarn guide, in the form of chains or false balloons which absorb the changes in stress of the yarn and allow the stress of the yarn to be more constant, and therefore the shape and number of the balloons in the area between the yarn guide and the balloon diameter generating means or traveller-ring assembly to be more constant and stable, thereby preventing and reducing uncontrolled movements of the traveller which cause premature breakages of the yarn.

Nevertheless, the specific measurement of the inner diameter of the yarn guide depends on the geometry of the machine (the diameter of the ring, diameter of the winding tube, height of the tube, distance between the upper part of the tube and the exit point, distance between the yarn guide and the balloon diameter generating means, distance between the yarn exit point of the feeding means and the yarn guide, total distance between the yarn exit point and the balloon diameter generating means, and the spinning angle, angles of transition and disruption, etc.) and on the type of yarn to be processed, among others.

Preferably, the inner diameter of the yarn guide is between 0.01 and 0.9 times the diameter of the balloon diameter generating means.

Preferably, the inner diameter of the yarn guide is at least between 6 and 30 mm in ring spinning.

Preferably, the yarn spinning and/or twisting machine comprises means for changing the inner diameter of the yarn guide so as to allow the inner diameter of the yarn guide to be, at any moment of the spinning process, greater than the diameter of standard yarn guides and less than 1.1 times the balloon generating diameter.

Changing the inner diameter of the yarn guide allows controlling the vibrations generated in the area between the yarn feeding means and the yarn guide, and accordingly also controlling the stress of the yarn in the area between the yarn guide and the balloon diameter generating means.

Therefore, as an example, in order to produce a 20 Ne cotton yarn in multiple balloons with a machine the ring diameter of which is 40 mm, an optimal value is 0.3 times the diameter of 40 mm which corresponds to a yarn guide diameter of 12 mm with three balloons.

In a preferred embodiment, several yarn guides can be arranged in the entire area comprised between the yarn exit point of the feeding means and the balloon diameter generating means, said yarn guides can have different diameters and be located in different positions. This embodiment allows greater control of the vibrations generated in the multiple balloon area.

The inner diameters of the yarn guides can be the same or different and can also be changed as a function of time. The position of the yarn guides can be changed as a function of time.

In a preferred embodiment, when the yarn spinning and/or twisting machine is a machine with rings, it comprises in a novel and inventive manner, means for moving the relative position of the yarn guide with respect to the yarn exit point of the yarn feeding means with a path not aligned with the spin axis of the picking means during a spinning cycle such that the path of the yarn along the balloon generating area does not collide with the yarn picking means and the stress is more constant, and accordingly the shape and number of the balloons between the yarn guide and the traveller-ring assembly are more constant.

At the start of the spinning cycle, when the traveller-ring assembly which is movable in height is located in the lower area of the yarn picking means for the yarn, the yarn guide is generally centred with the axis of the yarn picking means for the yarn.

As the cycle progresses, i.e., as the traveller-ring assembly moves up vertically, the yarn guide also moves up with a path not aligned with the spin axis of the yarn picking means for the purpose of maintaining a distance between the yarn guide and the traveller-ring assembly such that it does not cause a significant change in stress of the yarn, and therefore the geometry of the multiple balloons is kept stable.

At the end of the spinning cycle, when the traveller-ring assembly is at the final point or the upper part of the yarn picking means, the yarn guide is located at the upper point of its path, as far as possible from the spin axis of the yarn picking means for the yarn and closer to the yarn exit point of the yarn feeding means.

The non-alignment of the yarn guide with respect to the spin axis of the yarn picking means causes the multiple balloon structure not to be aligned with the spin axis of the yarn picking means. Nevertheless, and as a result of the relative position of the yarn guide and the traveller-ring assembly with respect to the yarn exit point of the yarn feeding means, it is ensured that the path of the yarn along the balloon generating area does not collide with the yarn picking means.

At the same time, the non-alignment of the yarn guide preferably allows, during an entire spinning cycle, keeping a spinning angle less than 60° with respect to the vertical, and subsequently stabilising the process, something which would be impossible if the yarn guide were to move vertically at all times aligned with the spin axis of the yarn picking means.

The spinning angle is defined as the angle formed by the straight line of the yarn exit point and the upper point of the path of the yarn guide and the vertical at any given time of a spinning cycle.

The path of the yarn guide for going from the lower point to the upper point may or may not be linear, i.e., it can be a combined path with linear and curved movement.

In a preferred embodiment, the orientation of the yarn guide is not horizontal.

In another preferred embodiment, the orientation of the yarn guide can be changed with respect to the horizontal position.

In a preferred embodiment, the machine comprises programmable control means for changing the position of the yarn guide with respect to the position of the traveller-ring assembly based on the stress of the yarn and/or position of the traveller-ring assembly and thereby keeping the stress of the yarn, and accordingly the number of balloons, as constant as possible. In this embodiment, the machine may comprise means for knowing the stress of the yarn and/or means for knowing the position of the traveller-ring assembly.

As a result of the machine that has been described, it is possible to perform a method for spinning and/or twisting yarns comprising a step in which the relative position of the yarn guide is moved with respect to the yarn exit point of the yarn feeding means with a path not aligned with the spin axis of the yarn picking means during a spinning cycle, such that the path of the yarn along the balloon generating area does not collide with the yarn picking means and the stress is more constant, and accordingly the shape and number of the balloons between the yarn guide and the balloon diameter generation are more constant.

Preferably, the method for spinning and/or twisting yarns may comprise one or all of the following steps:

Moving the yarn guide with a linear or non-linear path.

Moving the yarn guide with a path having a first segment which moves the yarn guide onto the spin axis of the yarn picking means for the yarn and a second segment which moves the yarn guide away from the spin axis of the yarn picking means.

Changing the orientation of the yarn guide with respect to the horizontal at a point of its path.

Automatically changing, as a result of programmable control means, the position of the yarn guide with respect to the position of the traveller-ring assembly based on the stress of the yarn and/or position of the traveller-ring assembly, and thereby keeping the stress of the yarn, and accordingly the number of balloons, as constant as possible.

It is also possible to modify a standard yarn spinning and/or twisting machine so that it performs the method described above.

For a standard yarn spinning and/or twisting machine to perform the method described above, the following steps will be performed:

Removing the original yarn guide.

Removing balloon limiters.

Incorporating a system for moving a yarn guide which allows moving the relative position of the yarn guide with respect to the yarn exit point of the yarn feeding means with a path not aligned with the spin axis of the yarn picking means during a spinning cycle, such that the path of the yarn along the balloon generating area does not collide with the yarn picking means and the stress is more constant, and accordingly the shape and number of the balloons between the yarn guide and the balloon diameter generating means are more constant.

Optionally, all or part of the following steps can be performed:

Installing means for changing the orientation of the yarn guide with respect to the horizontal.

Installing means for knowing the stress of the yarn and/or means for knowing the position of the traveller-ring assembly.

Installing programmable control means for changing the position of the yarn guide with respect to the position of the traveller-ring assembly based on the stress of the yarn and/or position of the traveller-ring assembly and thereby keeping the stress of the yarn, and accordingly the number of balloons, as constant as possible.

DESCRIPTION OF THE DRAWINGS

To complete the description provided herein, and for the purpose of helping to make the features of the invention more readily understandable, this description is accompanied by drawings constituting an integral part of the same, which by way of illustration and not limitation represents the following:

FIG. 1A shows a schematic view of the depiction of a yarn spinning and/or twisting machine with the yarn guide located at the lower point of its rectilinear path and not aligned with the spin axis of the picking means and the traveller-ring assembly located in the minimal initial position.

FIG. 1B shows a schematic view of the depiction of the yarn spinning and/or twisting machine shown in FIG. 1A, in this case with the yarn guide located at the upper point of its rectilinear path and not aligned with the spin axis and the ring located in the maximum end position.

FIG. 2A again shows a schematic view of the depiction of a yarn spinning and/or twisting machine, herein depicted with the yarn guide located at the lower point of its rectilinear path and not aligned with the spin axis of the picking means and the ring located in the minimal initial position, where in this case, the yarn guide furthermore has an angle of inclination of several degrees with respect to the horizontal.

FIG. 2B shows a schematic view of the depiction of the yarn spinning and/or twisting machine shown in FIG. 2B, in this case depicted with the yarn guide located at the upper point of its rectilinear path and not aligned with the spin axis of the picking means and with the ring located in the maximum end position, the yarn guide having an angle of inclination of several degrees with respect to the horizontal.

FIG. 3A likewise shows a schematic view of the depiction of a yarn spinning and/or twisting machine, in this case, with the yarn guide located at the lower point of its non-rectilinear path and not aligned with the spin axis of the yarn picking means and the ring located in the minimal initial position.

FIG. 3B shows a schematic view of the depiction of the yarn spinning and/or twisting machine shown in FIG. 3B but, in this case, with the yarn guide located at the upper point of its non-rectilinear path and not aligned with the spin axis of the yarn picking means and the ring located in the maximum end position.

FIG. 4 shows an elevational view of another schematic depiction of another example of a yarn spinning and/or twisting machine with more than one balloon, according to the state of the art, where the main parts and elements it comprises, as well as the relative arrangement thereof, can be seen.

Figure 5:
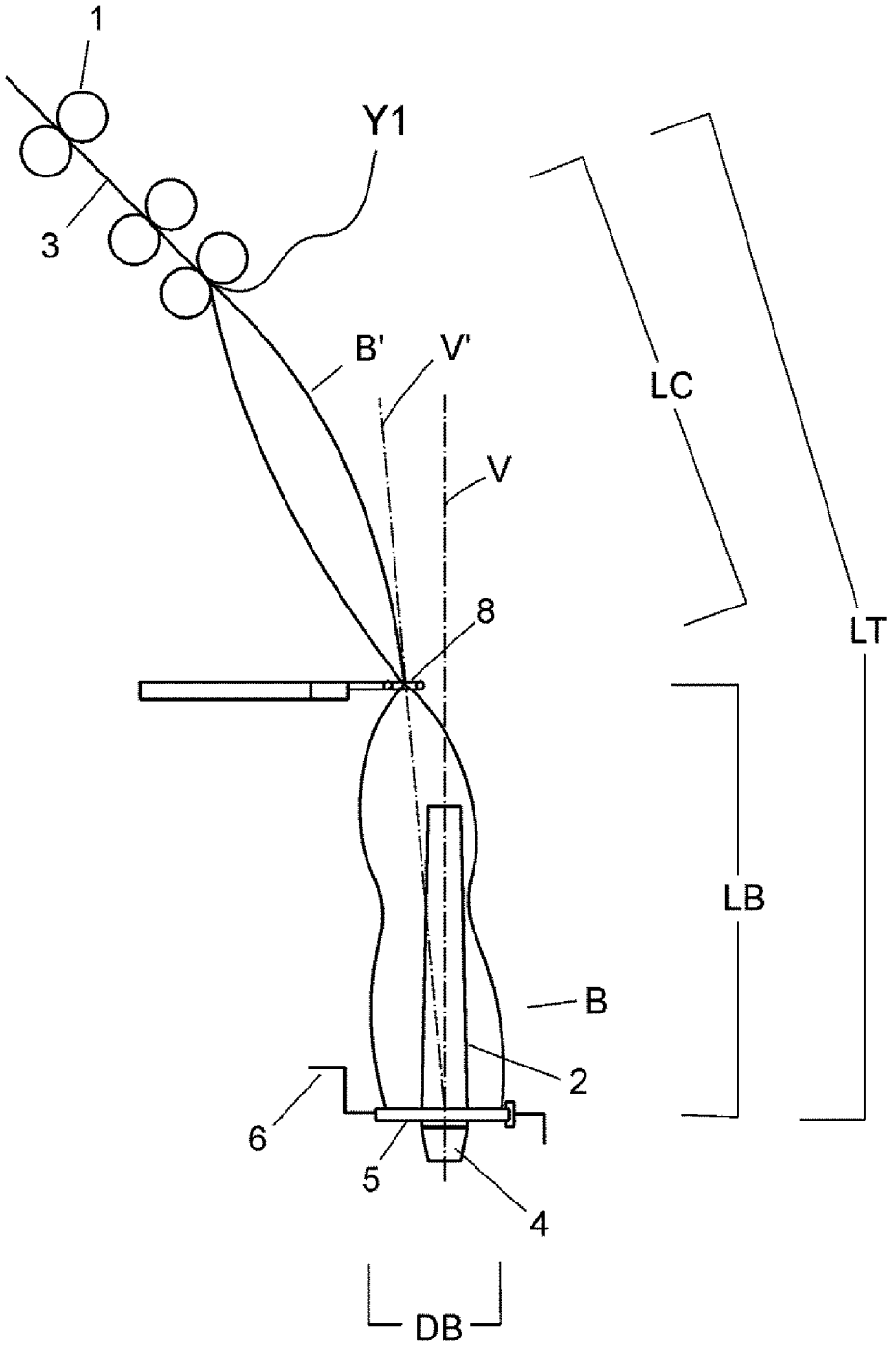
FIG. 5 shows a schematic view similar to that shown in FIG. 4, in this case with a yarn guide with an inner diameter of the yarn guide being greater than the diameter of standard yarn guides and less than 1.1 times the balloon generating diameters which causes vibrations between the yarn feeding means and the yarn guide.

FIG. 5 shows a schematic view similar to that shown in FIG. 4, in this case with a yarn guide with an inner diameter of the yarn guide being greater than the diameter of standard yarn guides and less than 1.1 times the balloon generating diameters which causes vibrations between the yarn feeding means and the yarn guide.

Figure 6:
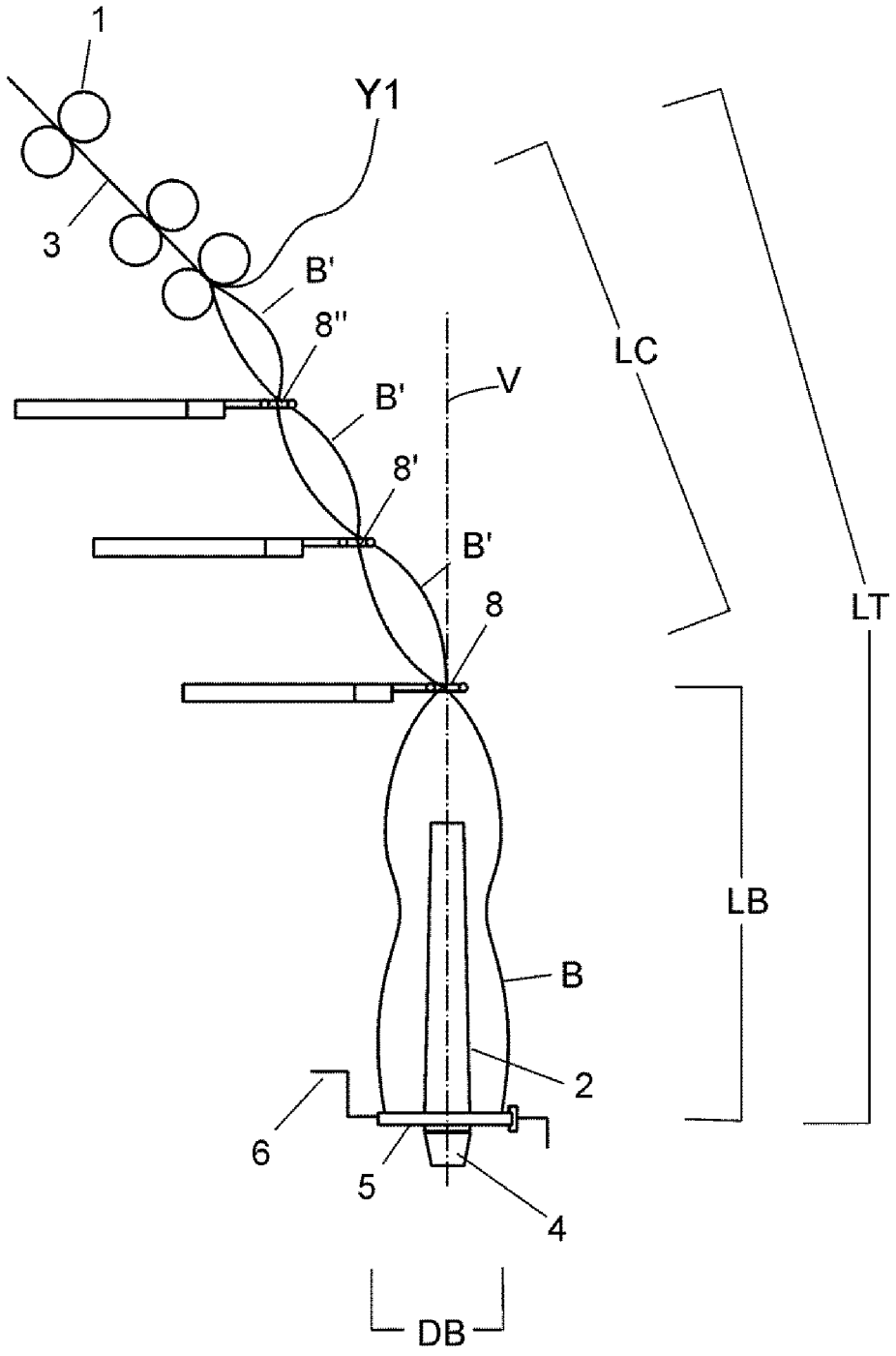
FIG. 6 shows a schematic view similar to those shown in FIGS. 4 and 5, in this case in an example with several yarn guides with an inner diameter of the yarn guide being greater than the diameter of standard yarn guides and less than 1.1 times the balloon generating diameters which cause different vibrating areas between the yarn feeding means and the yarn guide.

FIG. 6 shows a schematic view similar to those shown in FIGS. 4 and 5, in this case in an example with several yarn guides with an inner diameter of the yarn guide being greater than the diameter of standard yarn guides and less than 1.1 times the balloon generating diameters which cause different vibrating areas between the yarn feeding means and the yarn guide.

Figure 7:
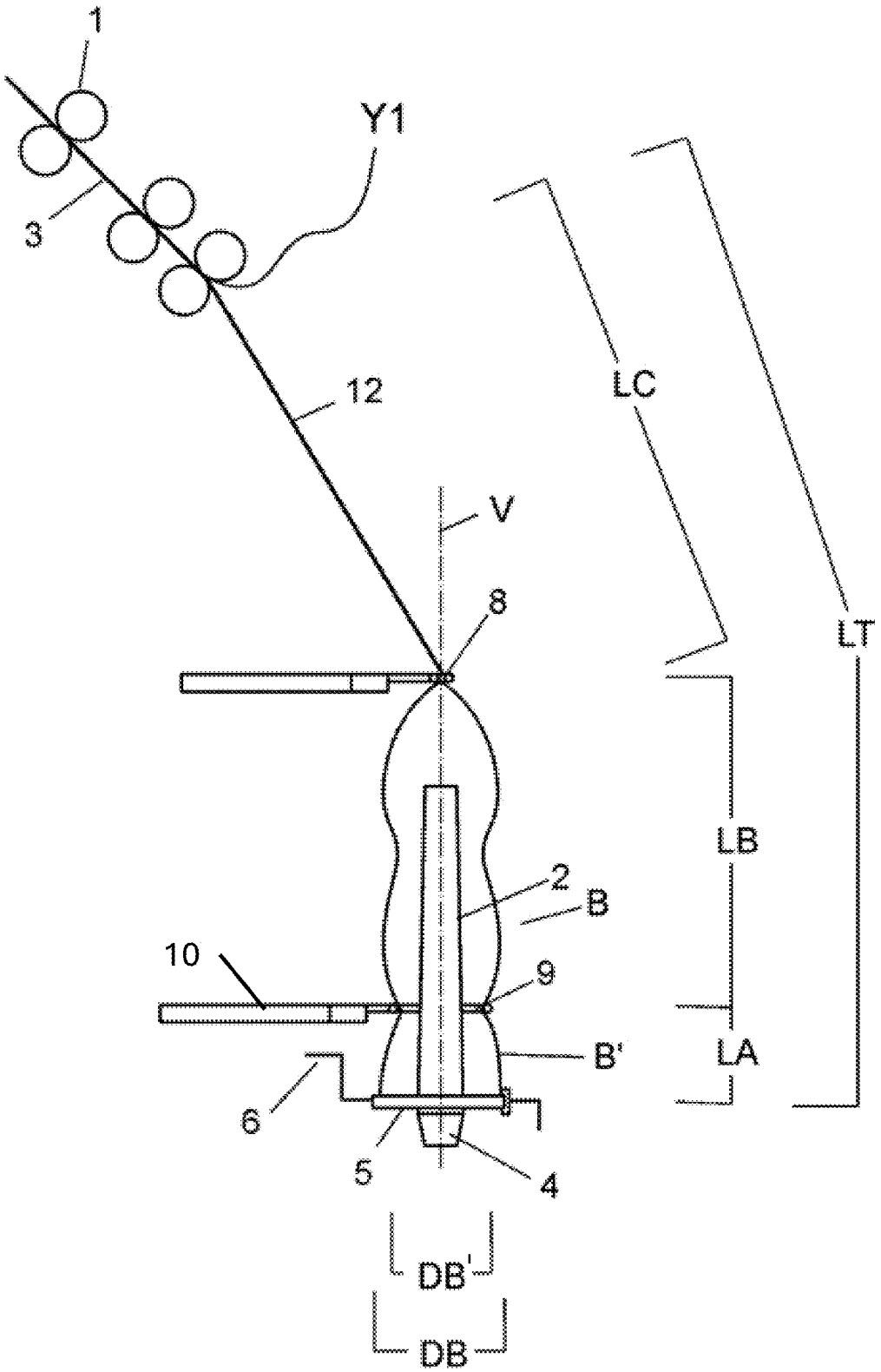
FIG. 7 shows a schematic view similar to that shown in FIG. 6, in this case in an example with a traveller stabiliser element located inside the spindle of the yarn picking means.

FIG. 7 shows a schematic view similar to that shown in FIG. 6, in this case in an example with a traveller stabiliser element located inside the spindle of the yarn picking means.

The number of balloons (B) depicted in the figures within the area (LB) is not limited to two balloons.

PREFERRED EMBODIMENT OF THE INVENTION

In view of the mentioned figures, different embodiments of the invention can be observed in a schematic depiction of a yarn spinning and/or twisting machine, in accordance with the numbering adopted according to the following list of reference numbers:

1. Yarn feeding means.

2. Tube.

3. Fibre structure.

4. Spindle or yarn picking means.

5. Traveller-ring assembly.

6. Ring frame.
8. Yarn guide. 8' Intermediate yarn guide, 8" upper yarn guide.
9. Traveller stabiliser element.
10. Traveller
12. Yarn
Y1. Yarn exit point of the feeding means.
V. Spin axis of the spindle or yarn picking means and of the balloon diameter generating means.
V'. Axis of the yarn guide which is off-centred with respect to axis V
T: Path of the yarn guide between the lower point (X) and the upper point (Y)
X. Lower point of the path of the yarn guide
Y. Upper point of the path of the yarn guide
Z. Point of minimal initial position of the traveller-ring assembly.
W. Point of maximum end position of the traveller-ring assembly.
B. Balloons.
B'. Vibrations of the yarn or false balloons
DB. Balloon generating diameter.
DB'. Diameter of the traveller stabiliser element (9)
LB. lower balloon generating area, between the yarn guide and the yarn picking means or the balloon diameter generating means.
LC. Upper area between the yarn exit point of the feeding means and the yarn guide.
LA. Area close to the ring between the traveller stabiliser element and the traveller-ring assembly.
LT. Total sum area of the lower area and the upper area, between the yarn exit point of the feeding means and the picking means.
α. Angle of inclination of the yarn guide with respect to the horizontal.
β. Spinning angle between points (Y1) and (Y) with respect to the vertical As seen in FIG. 4 depicting a yarn spinning and/or twisting machine with rings, a fibre structure (3) or roving is fed to a drawing device and drawn as it passes through the drawing device. In this embodiment, the yarn feeding means (1) are considered the drawing device. The fibre structure (3) or roving leaves the yarn feeding means (1) through an exit point (Y1) and is guided by a yarn guide (8) towards the mobile traveller-ring assembly (5) (balloon generating means (DB)), usually incorporated in a ring frame (6). Between the yarn guide (8) and the traveller-ring assembly (5), the fibre structure (3) or roving creates at least two balloons (B), twisting the fibre structure and producing a yarn (12). Finally, after going through the traveller-ring assembly (5), the yarn (12) is wound on the yarn picking means, such as a tube (2) which is coupled on a spinning spindle (4) which spins about a usually vertical axis (V).

The object of the invention is also applicable to other yarn spinning and/or twisting machines that work with balloon; among others, cabling twisting machines, 2×1 or TFO double twisting machines, and mills. All the yarn spinning and/or twisting machines that work with balloon comprise balloon generating means (DB) and a yarn guide (8).

The object of the invention is to use a yarn guide with an inner diameter of the yarn guide (8) greater than the diameter of standard yarn guides (8) and less than 1.1 times the generating diameter (DB), instead of a standard yarn guide, in yarn spinning and/or twisting machines that work with multiple balloons.

The use of a yarn guide with an inner diameter of the yarn guide (8) greater than the diameter of standard yarn guides (8) and less than 1.1 times the balloon generating diameter (DB) allows creating two areas with different functions.

A first area or upper area (LC), which is the one located between the yarn exit point (Y1) of the yarn feeding means (1) for the yarn and the yarn guide (8), where vibrations or a false balloon (B') which, by means of continuous collapses, absorbs the differences in stress during spinning, are created, allowing the balloons (B) of the second area to be more stable.

A second area or lower area (LB), which is the one located between the yarn guide (8) and the balloon diameter generating means (DB), which is where multiple stable balloons (B) are generated.

The selection of the inner diameter of the yarn guide (8) depends on the stress and the stability produced in the system during the time of spinning package formation.

In a preferred embodiment, the inner diameter of the yarn guide (8) is between 0.01 and 0.9 times the diameter of the balloon diameter generating means (DB).

In another preferred embodiment, the inner diameter of the yarn guide (8) is at least of 6 mm and at most 30 mm.

In an optional embodiment depicted in FIG. 6, instead a single area with false balloons (B'), several areas with false balloons (B') are present by means of the placement of several yarn guides, (referred to as the lower yarn guide (8), the intermediate yarn guide (8'), and the upper yarn guide (8")), with an inner diameter of the yarn guide (8) being greater than the diameter of standard yarn guides (8) and less than 1.1 times the balloon generating diameter (DB), achieving a more precise regulation of the system with the same purpose, variable or not variable in each yarn guide (8, 8', 8").

In a preferred embodiment, the yarn spinning and/or twisting machine comprises means for changing the inner diameter of the yarn guide (8) during the spinning and/or twisting process so as to allow the inner diameter of the yarn guide to be, at any moment of the spinning process, greater than the diameter of standard yarn guides (8) and less than 1.1 times the balloon diameter generator (DB).

In a preferred embodiment, as seen in the example of FIG. 7, the yarn spinning and/or twisting machine comprises a traveller stabiliser element (9) located inside the length of the tube (2) of the yarn picking means. To that end, it is necessary for the inner diameter of the traveller stabiliser element (9) to be greater than the diameter of the tube (2) of the picking means and less than the balloon diameter generator (DB) and preferably less than diameter (DB). The traveller stabiliser element (9) can be considered a yarn guide since the diameter (DB) is less than 1.1.

With the traveller stabiliser element (9) located close to the balloon diameter generating means (DB) an area is generated close to the ring (LA) between the traveller stabiliser element (9) and the traveller (10).

The traveller stabiliser element (9) has the same capacity of movement with respect to the traveller-ring assembly (5) as described above.

The inner diameter of the traveller stabiliser element (9) can change during the spinning process.

In this embodiment, the area (LB) where multiple stable balloons are generated is the one located between the traveller stabiliser element (9) and the yarn guide (8).

In this case, a false balloon (B') which absorbs the differences in stress during spinning is created in the area close to the ring (LA), allowing the balloons (B) of the upper area (LB), between the traveller stabiliser element (9) and the upper yarn guide (8), to be more stable.

Another advantage of this embodiment (shown in FIG. 7) is the reduction of the balloon generating diameter (DB) from which the multiple balloon area (LB) is generated. In other words, in this embodiment, the balloon generating diameter is the diameter (DB') of the traveller stabiliser element (9). The reduction of the balloon generating diameter allows generating multiple balloons with an area (LB) having a smaller length.

Another advantage of this embodiment is the reduction of the balloon generating diameter (DB) from which the multiple balloon area (LB) is generated. In other words, in this embodiment, the balloon generating diameter is the diameter of the traveller stabiliser element (9). The reduction of the balloon generating diameter allows generating multiple balloons with an area (LB) having a smaller length.

In a preferred embodiment, as seen in FIGS. 1A, 1B, 2A, 2B, 3A, and 3B, a fibre structure (3) or roving is fed to a drawing device and drawn as it passes through the drawing device. In this embodiment, the yarn feeding means (1) are considered the drawing device. The fibre structure (3) or roving leaves the yarn feeding means (1) through an exit point (Y1) and is guided by a yarn guide (8) towards the mobile traveller-ring assembly (5), usually incorporated in a ring frame (6). Between the yarn guide (8) and the traveller-ring assembly (5), the fibre structure (3) or roving creates at least two balloons (B), twisting the fibre structure and producing a yarn (12). Finally, after going through the traveller-ring assembly (5), the yarn (12) is wound on the yarn picking means, such as a tube (2) which is coupled on a spinning spindle (4) which spins about a usually vertical axis (V).

In a preferred embodiment, the yarn spinning and/or twisting machine with rings, the yarn guide (8) follows a path (T) between a lower point (X) and an upper point (Y) which does not coincide with the axis (V) of the picking means.

In order to prevent the path of the yarn along the multiple balloon generating area (LB), between the yarn guide (8) and the yarn picking means, from colliding with the picking means for the yarn (3) and to prevent an excessive increase in the spinning angle ((3), i.e., the yarn exit angle (Y1), with respect to the vertical or spin axis (V) of the picking means, when said yarn exit point (Y1) of the yarn feeding means (1) is not aligned with said spin axis (V) of the yarn picking means, the path (T) of the yarn guide (8) will never be entirely aligned with the spin axis (V) of the spindle (4) or the yarn picking means.

Specifically, FIGS. 1A and 1B show, respectively, the two positions of the traveller-ring assembly (5) and of the yarn guide (8), at the start of the spinning cycle (points Z and X, respectively) and at the end of the spinning cycle (points W and Y, respectively), and in this case the path (T) of the yarn guide (8) is a straight line inclined with respect to the spin axis (V) of the spindle (4) or the picking means.

Specifically, FIGS. 2A and 2B show, respectively, the two positions of the traveller-ring assembly (5) and of the yarn guide (8), at the start of the spinning cycle (points Z and X, respectively) and at the end of the spinning cycle (points W and Y, respectively), and in this case the path (T) of the yarn guide (8) is a straight line inclined with respect to the spin axis (V) of the spindle (4). The difference with the machine depicted in FIGS. 1A and 1B is that the machine depicted in FIGS. 2A and 2B comprises a yarn guide (8) inclined with an angle (a) of certain degrees with respect to the horizontal position to enable the improved orientation thereof in the position of the upper point (Y), close to the exit point (Y1).

Furthermore, specifically, FIGS. 3A and 3B show, respectively, the two positions of the traveller-ring assembly (5) and of the yarn guide (8), at the start of the spinning cycle (points Z and X, respectively) and at the end of the spinning cycle (points W and Y, respectively), and in this case the path (T) of the yarn guide (8) is not linear. The path (T) of the yarn guide (8) has an inclination with an angle (a) of certain degrees with respect to the horizontal position, and this causes the inclination of the yarn guide (8) at its upper point (Y) and the improved orientation thereof.

In a preferred embodiment, according to FIGS. 3A and 3B, the initial part of the path (T) of the yarn guide (8) is straight and centred with the axis (V) and allows the yarn guide (8) to be moved up vertically in a sufficient manner so as to prevent the yarn from contacting the yarn picking tube (2) before starting to decentre the yarn guide (8) with respect to the axis (V) by means of the final part of the curved path (T).

The path (T) depicted in the figures must be drawn on the yarn guide (8) and not at the opposite end of the actuator comprising the yarn guide. It has been decided to draw the path at this point so as not to make it harder to understand the figures. Accordingly, in the case where the angle (a) is changed during the spinning process, the path (T) may not coincide with that depicted in the figures.

Optionally, the orientation of the yarn guide (8) is not horizontal.

Optionally, the yarn spinning and/or twisting machine comprises means for changing the orientation of the yarn guide (8) with respect to the horizontal position.

Preferably, in one embodiment, as the yarn guide (8) moves along the path (T) from the lower point (X) to the upper point (Y), said yarn guide (8) is inclined with respect to the horizontal line with an angle ($\alpha$) which is within a range of between −45° and +45°.

The way for obtaining non-linear movement paths is not specified in this application, since devices moving parts of a machine following said paths are well known in the state of the art.

This stress of the yarn, the position of the traveller, or the shape of the balloons can be changed during the spinning and/or twisting process in three ways:

a) Changing the yarn exit point (Y1) of the yarn feeding means (1)

b) Changing the diameter of the yarn guide (8)

c) Using the combination of ways a) and b)

By changing one variable, the other variable, or all two variables at the same time, the stress of the yarn in the system is changed by increasing or decreasing it, causing the changes in the state or transition between balloons to be eliminated.

By means of this technique, the balloon state change transition time can also be minimised by changing the stress of the system, such that the balloon change occurs immediately due the high stress that is supplied.

Therefore, as mentioned above, the yarn passing through the traveller is caused to always have an angle greater than 90° with respect to the base of the ring, with the traveller working in a stable position, rubbing against the ring in the common contact area.

Premature wear of the traveller and breakages of yarn are thereby reduced.

This new way of changing and adjusting the balloons can be performed in three ways:

In real time

By means of a prior test

By setting the previously obtained parameters for a specific spinning

The way to perform a change in real time consists of capturing the yarn stress parameters and/or the position of the traveller, and/or the shape of the balloons obtained by means of a sensor for that purpose using any system or optical means, electrical means, electronic means, mechanical means, load cell, etc., which provides a digital signal, analogue signal, mechanical signal, or signal of any type that can be processed and using mechanisms of any type, PLC, pneumatic, hydraulic, mechanical, electric, electronic, magnetic, etc., and changing, in real time, the position of the yarn guide (8) with respect to the yarn exit point (Y1) of the yarn feeding means (1) and/or changing the inner diameter of the yarn guide (8) such that the stress which has been changed keeps the shape of the balloons constant.

One of the ways to change the position of the yarn guide (8) with respect to the yarn exit point (Y1) of the yarn feeding means (1) is by means of gear motor, PLC screen, and specific software which transforms the signal into movement.

In this manner, the stress is changed in real time when the occurrence of interferences or changes in the state of the balloons is detected, thereby preventing the traveller from sustaining premature wears.

The system can also be used to perform balloon state shifts in a very quick manner without the traveller being affected by the interferences for a prolonged time, which causes premature wear of the traveller.

By means of a prior test, what the position of the yarn guide (8) should be with respect to the yarn exit point (Y1) of the yarn feeding means (1) and/or what the inner diameter of the yarn guide (8) should be can be determined based on the position of the traveller-ring assembly (5). This learning can be programmed in programmable control means (not depicted) so that, during the spinning cycle, the position of the yarn guide (8) with respect to the yarn exit point (Y1) of the yarn feeding means (1) can be kept constant, increased, or reduced, as appropriate, and/or the inner diameter of the yarn guide (8) can be changed based on the position of the traveller-ring assembly (5) with respect to the yarn exit point (Y1) of the yarn feeding means (1).

Among other systems, these adjustments can be made by means of an electromechanical movement operated through software and a PLC, and a stress sensor, or optical sensor, etc., which provides the parameters in each position.

This system allows adjusting the distance and/or the inner diameter of the yarn guide for each variable affecting the stress and the shape of the balloon such as, the titre, the twisting, the material (100% cotton, PES. PA, mixtures . . . ), the spinning process (combing, carding, etc.), the diameter of the ring, the height of the tube, the model of the machine, the brand of the machine, the compact system, and a large number of variables.

In the case that the exact parameters of the spinning are known and according to a specific traveller-ring diameter, both the lower area (LB) and the upper area (LC) can be established and set, and the inner diameter of the yarn guide (8) can be pre-established.

Having sufficiently described the nature of the present invention, as well as the ways of implementing it, it is not considered necessary to expand its explanation for any person skilled in the state of the art to understand its scope and the advantages which derive from it.

The invention claimed is:

1. A yarn spinning and/or twisting machine that operates with multiple balloons, comprising:

a yarn feeding means (1);

a yarn picking means (4) for the yarn with a spin axis (V);

a balloon diameter generating means (DB) comprising a traveller-ring assembly (5);

a drive means connected to the yarn picking means (4) for the yarn; and several yarn guides, (8, 8', 8") located between the yarn feeding means (1) and the yarn picking means (4) for the yarn, at least one of the several yarn guides, (8, 8', 8") with an inner diameter greater than the diameter for each type of yarn and less than 1.1 times the diameter of the balloon diameter generating means (DB).

2. The yarn spinning and/or twisting machine according to claim 1, wherein the inner diameter of at least one of the several yarn guides (8, 8', 8") is between 0.01 and 0.9 times the diameter of the balloon diameter generating means (DB).

3. The yarn spinning and/or twisting machine according to claim 1, wherein the inner diameter of at least one of the several yarn guides (8, 8', 8") is at least 3 mm.

4. A yarn spinning and/or twisting machine that operates with multiple balloons, comprising:

a yarn feeding means (1);

a yarn picking means (4) for the yarn with a spin axis (V);

a changeable yarn guide (8) located between the yarn feeding means (1) and the yarn picking means (4) for the yarn;

a balloon diameter generating means (DB) comprising a traveller-ring assembly (5);

a drive means connected to the yarn picking means (4) for the yarn; and wherein the changeable yarn guide (8) provides different inner diameters that are greater than the diameter for each type of yarn and less than 1.1 times the diameter of the balloon diameter generating means (DB).

5. The yarn spinning and/or twisting machine according to claim 4, further comprising:

a means for knowing the stress of the yarn and/or the position of a traveller and/or the shape of the balloons, and a programmable control means for changing the yarn guide (8) in real time based on the stress of the yarn and/or other parameters of the yarn spinning and/or twisting machine.

6. The yarn spinning and/or twisting machine according to claim 4, wherein the yarn spinning and/or twisting machine further comprises a traveller stabiliser element (9) located along the length of a tube (2) of the yarn picking means (4) and with a diameter greater than the tube (2) and less than 1.1 the balloon diameter generating means (DB).

7. The yarn spinning and/or twisting machine according to claim 4, wherein the inner diameter of the yarn guide (8) is between 0.01 and 0.9 times the diameter of the balloon diameter generating means (DB).

8. A yarn spinning and/or twisting machine comprising:

a yarn feeding means (1);

a yarn picking means (4) for the yarn with a spin axis (V);

a yarn guide (8) located between the yarn feeding means (1) and the yarn picking means (4) for the yarn;

a balloon diameter generating means (DB) comprising a traveller-ring assembly (5);

a drive means connected to the yarn picking means (4) for the yarn; and wherein the yarn feeding means (1) has a yarn exit point (Y1) not aligned with the spin axis (V) of the yarn picking means for the yarn (12);

wherein the balloon generating means (DB) and the traveller-ring assembly (5) are vertically movable and concentric with the axis (V); and wherein the yarn spinning and/or twisting machine further comprises a means for moving the relative position of the yarn guide (8) with respect to the yarn exit point (Y1) of the yarn feeding means (1) with a path (T) not aligned with the spin axis (V) during a spinning cycle such that the spinning angle (β) is less than 60° with respect to the vertical at all times and such that the path of the yarn along a lower balloon generating area (LB) forming at least 2 balloons does not collide with the picking means for the yarn (12) so that the spinning process is stable.

9. The yarn spinning and/or twisting machine according to claim 8, wherein the path (T) of the yarn guide (8) is linear.

10. The yarn spinning and/or twisting machine according to claim 8, wherein the path (T) of the yarn guide (8) is not linear.

11. The yarn spinning and/or twisting machine according to claim 8, wherein the path (T) of the yarn guide (8) has a first segment which moves the yarn guide (8) onto the spin axis (V) of the yarn picking means for the yarn (12) and a second segment which moves the yarn guide (8) away from the spin axis (V) of the yarn picking means for the yarn (12).

12. The yarn spinning and/or twisting machine according to claim 8, wherein the orientation of the yarn guide (8) is not horizontal.

13. The yarn spinning and/or twisting machine according to claim 8, further comprising means for changing the orientation of the yarn guide (8) with respect to the horizontal position.

14. The yarn spinning and/or twisting machine according to claim 8, wherein the yarn spinning and/or twisting machine further comprises means for knowing the position of the traveller-ring assembly (5) with respect to the yarn exit point (Y1) of the yarn feeding means (1) and/or means for knowing the stress of the yarn, and programmable control means changing the position of the yarn guide (8) with respect to the position of the traveller-ring assembly (5) based on the stress of the yarn and/or position of the traveller-ring assembly (5).

* * * * *